United States Patent [19]

Mock

[11] 4,301,858

[45] Nov. 24, 1981

[54] ADJUSTING MEANS OF ROTARY REGENERATIVE SECTOR PLATE HEAT EXCHANGERS

[75] Inventor: Karl H. Mock, Neckargemuend, Fed. Rep. of Germany

[73] Assignee: Svenska Rotor Maskiner AB, Nacka, Sweden

[21] Appl. No.: 127,765

[22] Filed: Mar. 6, 1980

Related U.S. Application Data

[63] Continuation-in-part of Ser. No. 70,796, Aug. 29, 1979, abandoned.

[51] Int. Cl.[3] ..... F28D 19/00

[52] U.S. Cl. ..... 165/9; 324/60 C; 340/870.37

[58] Field of Search ..... 165/9; 340/200; 324/60 C

[56] References Cited

U.S. PATENT DOCUMENTS

| | | | |
|---|---|---|---|
| 3,232,335 | 2/1966 | Kalbfleisch | 165/9 |
| 3,404,727 | 10/1968 | Mock | 165/9 |
| 3,669,183 | 6/1972 | Mock | 165/9 |
| 4,058,158 | 11/1977 | Blom et al. | 165/9 |

*Primary Examiner*—Albert W. Davis

*Attorney, Agent, or Firm*—Frishauf, Holtz, Goodman & Woodward

[57] ABSTRACT

Adjusting means for the sector plate sealing members of rotary regenerative heat exchangers, wherein at least one sensing means is attached to each sealing member, adjacent a circumferential metal flange supported by the regenerator body. The sensing means is connected to a control circuit for actuating a servo device for controlling the position of the sealing member in response to the capacity fluctuations in an electrical circuit comprising the space between the sensing means and the metal flange.

7 Claims, 4 Drawing Figures

ADJUSTING MEANS OF ROTARY REGENERATIVE SECTOR PLATE HEAT EXCHANGERS

CROSS-REFERENCE TO RELATED APPLICATION

This is a Continuation-In-Part application of U.S. application Ser. No. 70,796, filed Aug. 29, 1979, now abandoned.

BACKGROUND OF THE INVENTION

This invention relates to an adjusting means for the sector plate sealing members of rotary regenerative heat exchangers, and more particularly to an adjusting means which, in response to a thermal deformation of the regenerator body to a dish-like shape of the end surfaces of the regenerator body and the corresponding variation of the sealing spaces, actuates adjusting linkages of the sealing members by means of a servo device so as to maintain a predetermined sealing space, wherein at least one sensing means is attached to each sealing member adjacent a circumferential or annular metal flange or disc supported by the regenerator body.

Adjusting means of this type are known for instance from U.S. Pat. No. 3,232,335 (Canadian Pat. No. 704,958, GB Pat. No. 1,002,235) in which the sensing means are pneumatic, mechanical or magnetic.

One known pneumatic sensing means comprises a nozzle carried by the sealing member, an impingement plate (a circumferential flange) carried by the regenerator body and means for supplying pressure air to the nozzle, the pressure of the air being dependent on the position of said nozzle relative to said impingement plate and the servo device being operable to adjust the position of the sealing member according to that pressure.

Another known mechanical sensing means comprises a sensing lever carried by the sealing member, and a link connecting the lever to a control means for the servo device which is operable to adjust the position of the sealing member in response to displacement of the lever which is adapted to slide on a circumferential flange carried by the regenerator body.

Still another known magnetic sensing means comprises an electro-magnet located to produce a magnetic field between the circumferential flange and a sealing member, the servo device being operable to adjust the position of the sealing member according to current variations due to changes in the strength of the magnetic field, which is dependent on the position of the sealing member relative to the flange.

In all these known arrangements, the inclusion of a servo device brings about the advantage that very large adjustment forces can be produced so that even in very large size heat exchangers readjustment of the sealing members may be effected without difficulties. The smaller forces of the mechanical sensing lever are accompanied only by light wear and for that reason sensing levers of this type have a long working life.

These known arrangements have the disadvantages, however, of being subjected to physical and chemical attacks by the impurities contained in the waste flue gases and to the high temperatures of the gases resulting in a considerable reduction in the life of especially the magnetic sensing means in which the electrical windings or coils and their insulating materials are non-resistant to heat.

The object of this invention is to eliminate or at least reduce the above-mentioned disadvantages.

SUMMARY OF THE INVENTION

The above object has been achieved, according to the invention, in that the adjusting means of the kind defined hereinabove is characterized in that the sensing means is provided with an electrically conducting sensing element which is insulated from the sealing member and which is positioned close to the metal flange. The sensing element and the metal flange are electrically connected to a control circuit which is arranged to generate control signals indicating variations of capacity appearing in response to variations of the distance between the metal flange and said sensing element, which control signals are supplied to a servo device for adjusting the position of the sealing members.

In this manner there is provided an adjusting means comprising a sensing means that is subject to no wear. Since the sensing means is subjected to only light corrosion and erosion, its life can be considerably prolonged by the selection of appropriate heat resistant material.

The sensing means preferably comprises a cylindrical housing having two ends closed by insulating discs. One of the insulating discs, viz. the one facing the regenerator body, supports an electrically conducting sensing disc to which an electric conductor is connected extending through the two insulating discs to a pin plug device at the end of the sensing means facing away from the regenerator body.

A further pin plug device may be located adjacent the first mentioned pin plug device, said further pin plug device being connected to an electrical temperature sensing device attached to the cylindrical housing of the sensing means.

The conductor connected to the sensing disc preferably extends with a clearance through the insulating disc closing the end of the cylindrical housing facing away from the regenerator body, said conductor being longitudinally stretched by means of a compression spring and connected to its pin plug device via a further conductor forming an expansion curve.

Moreover, according to a preferred embodiment of the invention time delay means are interconnected in the electrical connection between the high frequency amplifier and the servo device controlling the adjusting of the sealing members, which suppress the influences of short-lived fluctuations of capacity, and, hence, prevent the sealing means from being subjected to oscillatory motion.

DETAILED DESCRIPTION

Figure 1:
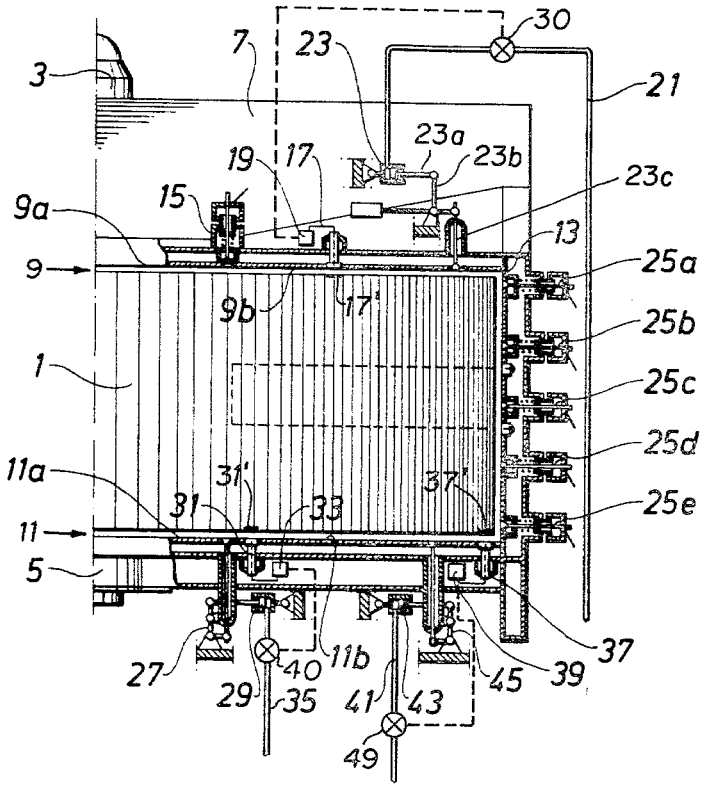
FIG. 1 is a part sectional view of a regenerative heat exchanger having a rotating regenerator body in which an adjusting means according to the invention is arranged for the sector plates disposed between the adjacent rotating and non-rotating end surfaces of the regenerative mass and the inlet and outlet ducts of each end thereof.

FIG. 1 is a partial sectional view of the right hand part of a rotating regenerative heat exchanger mounted for rotation about a vertical axis.

A rotating regenerative body 1 is journalled in an upper bearing 3 and in a lower bearing 5 and is enclosed by a housing 7.

The rotatable body 1 is in known manner subdivided into a plurality of sectorial comparatments and in order to prevent mingling of the two fluid flows there are provided an upper sector plate 9 and a lower sector plate 11 as well as vertical sealing plates 13. The upper and lower sector plates are subdivided into a central section 9*a*, 11*a* and outer sections 9*b*, 11*b*, the sections being pivotally connected to each other. The link between the central section 9*a* and the adjacent outer section 9*b* of the upper sector plate is adjustable by means of an adjusting rod 15 against the action of a spring member on the upper end wall of the housing. A central portion of the outer section 9*b* is according to the invention provided with a sensing means 17 just above a circumferential metal flange or disc 17′ supported by said regenerator body 1, and a control circuit 19 which includes a high frequency amplifier. The signals generated by the control circuit 19 control a solenoid valve 30 connected in a pressure fluid supply conduit 21 of a control cylinder 23. Control cylinder 23 controls a control rod 23*c* via piston rod 23*a* and a knee lever 23*b* under the action of a counterweight, the control rod 23*c* being connected to the outer end portion of the outer section 9*b* of the upper sector plate sealing means.

Similar control rod arrangements 25*a* to 25*c* with spring means are provided for supporting and adjusting the vertical sealing plate 13.

The adjusting means of the upper sector plate sealing means, in this case positioned in the hot end of the heat exchanger, differs from the adjusting means of the lower sector plate sealing means in the cold end of the heat exchanger. Due to the fact that the rotor containing the regenerative mass when operated undergoes a thermal deformation and adopts a dish-like form, the end surfaces of the rotor will become convex and concave, respectively. Thus, close to the control rod supporting the link between sections 11*a* and 11*b*, there is provided, just underneath a circumferential metal flange or disc 31′ attached to the regenerator body 1, a first sensing means 31 connected to a control circuit 33 which includes a high frequency amplifier. The signal generated by the control circuit 33 controls a solenoid valve 40 in a pressure fluid supply conduit 35 feeding a control cylinder 29 which in this case actuates the link between lower sector plate section 11*a* and the adjacent section 11*b* in response to the signals generated by the sensing means 31, 31′, which link is moved by cylinder 29 over a linkage 27 perpendicular to the lower end surface of the regenerator body. The outer end of the lower sector plate section 11*b*, just underneath a circumferential flange or disc 37′ attached to the regenerator body 1, is also provided with a sensing means 37, connected to a control circuit 39 which includes a high frequency amplified. The output signals of control circuit 39 actuate a solenoid valve 49 in a supply conduit 41 of a control cylinder 43 controlling via a linkage 45 the position of the outer end of section 11*b*. Thus, the position of the outer sections 9*b* of the upper section plate sealing means of the hot end of the heat exchanger, which end surface becomes convex, is each controlled by a sensing means only; but at the lower sector plates the links between control sections 11*a* and the adjacent outer sections 11*b* as well as the outer ends of the outer sections 11*b* are each adjusted by a sensing means 31, 31′; 37, 37′ in response to concave deformation of the lower end surface of the regenerator body, i.e. the cold end of the regenerator body.

Figure 2:
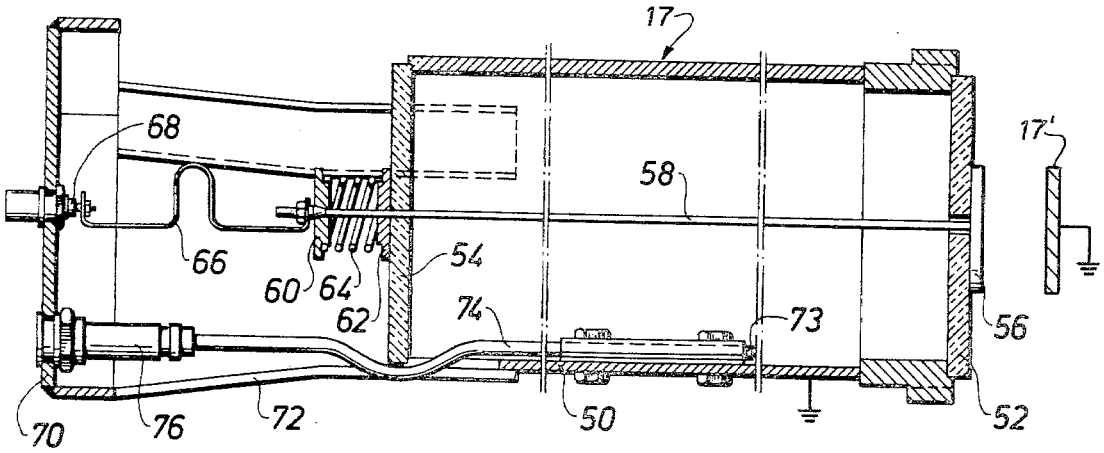
FIG. 2 is a sectional view on a larger scale of a sensing means included in the adjusting means shown in FIG. 1 for sensing the clearances between the end surfaces of the regenerative mass and the sector plate sealing members.

FIG. 2 is a sectional view on a larger scale of a sensing means 17, 17′ according to the invention. Sensing means 31, 31′ and 37, 37′ are substantially identical. The sensing means 17, 17′ comprises a cylindrical housing 50 positioned in a suitable opening of the sector plate and fixedly attached to said sector plate. Both ends of the housing 50 are closed by respective insulating discs 52, 54. Disc 52 supports an electrically conducting sensing disc 56, suitably made of metal, to which an electric conductor 58 is attached, conductor 58 extending through control aperturesof the insulating discs 52 and 54. The outer end of conductor 58 (with respect ot the heat exchanger housing) is provided with a thrust washer 60 which together with a compression spring 64 and a washer 62 applies tension to conductor 58 under all thermal conditions. A further conductor section 66 having an expansion blow connects the outer end of conductor 58 to a pin plug device 68 attached to a base plate 70. Base plate 70 is attached to housing 50 by three supporting arms 72. A temperature sensing device 73 is connected via a conductor 74 to a further pin plug device 76 attached to the base plate 70. The temperature sensing device 73 is designed to compensate for changes of the dielectric value of the gases in dependence of the temperature. Sensing disc 17′ is coupled to the corresponding control circuit 19 via a common ground connection. The pin plug device 68, 76 are connected via a cable to the input of a corresponding control circuit which develops control signals which are a function of the capacitance between sensing discs 56 and 17′. The control circuit generates amplified control signals which are selectively supplied via conductors to the associated solenoid valves (30, 40, 49) positioned in the pressure fluid supply conduits of the corresponding control or power cylinders. The valves are actuated and controlled by the corresponding control circuit for adjusting the position of the sealing members during thermal distortion of the regenerator body so as to maintain the sealing members in a predetermined position relative to said regenerator body.

The operating mode of the ajusting device according to the invention is explained in more detail below.

Each sensing means is coupled to a respective control circuit for generating an output control voltage responsive mainly to the capacitance between two parallel discs (the sensing disc 56 and the circumferential disc such as 17′, 31′, 37′ attached to the regenerator body), and the temperature of the gas present between said two discs which acts as a dielectric medium.

Figure 3:
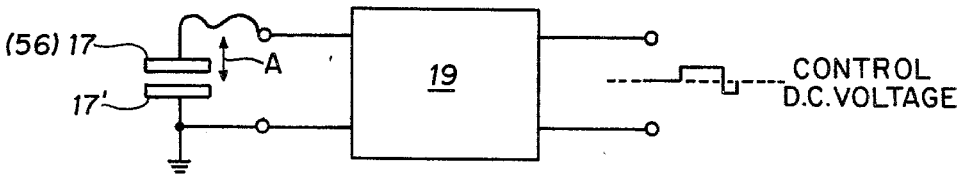
FIG. 3 is a general block diagram of a control circuit of the present invention.

FIG. 3 illustrates a basic diagram of a control circuit according to the present invention. Only control circuit 19 is illustrated, the control circuits 33 and 39 being identical thereto. As shown in FIG. 3, the sensing discs 56, 17′ are connected to a control circuit 19 which generates a control voltage, such as a stepwise varying DC control voltage, as illustrated. The sensing disc 56 is adapted to have its position varied in the direction of the arrow A shown in FIG. 3 relative to the annular disc 17'. Due to the variations in position of disc 56 relative to disc 17'. Due to the variations in position of disc 56 relative to disc 17', the electrical capacitance therebetween varies and these variations in electrical capacitance are sensed by the control circuit which generates a corresponding control output voltage. In other words, the control output voltage of control circuit 19 is dependent upon the distance or spacing between the sensing metallic discs 17' and 56 of the sensing means. The annular sensing discs or electrodes 17', 31' and 37' are supported by the various portions of the regenerator body as shown in FIG. 1. The control circuit can also be thought of as electro-mechanical converters which generate an electrical control signal responsive to a sensed mechanical relative movement.

Figure 4:
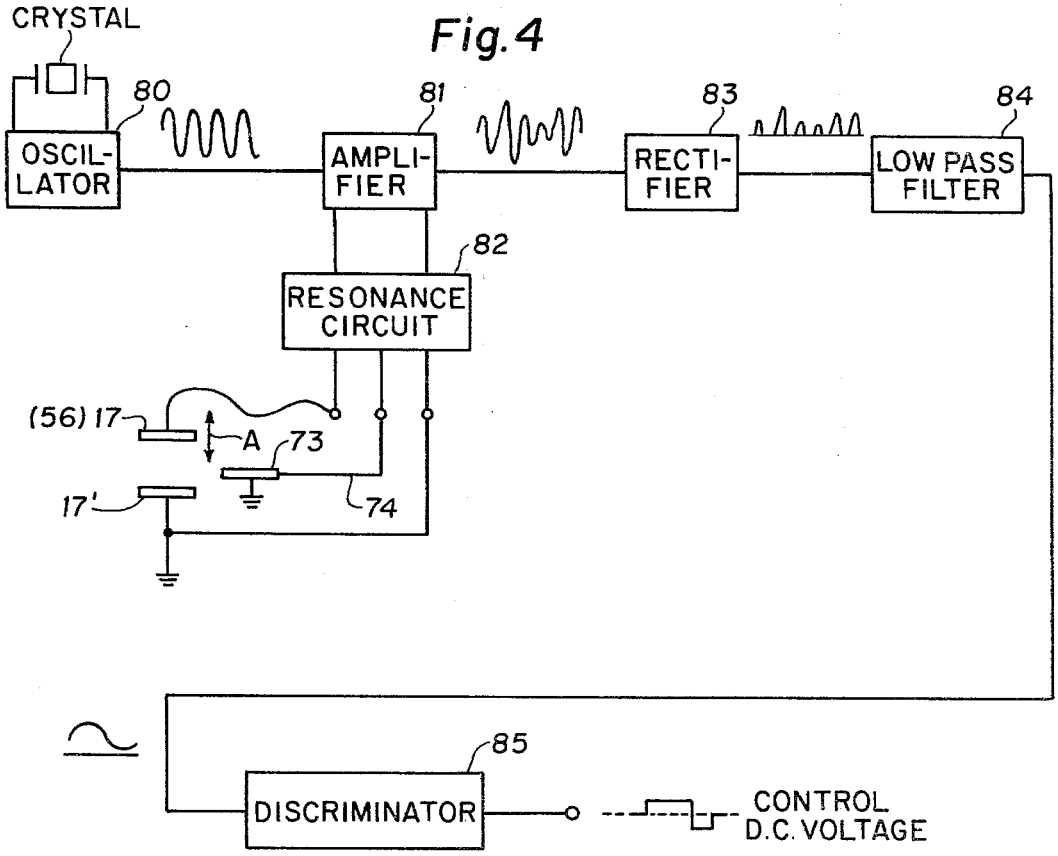
FIG. 4 is a more detailed block diagram of the control circuit of FIG. 3.

Referring to FIG. 4, the control circuit comprises a crystal controlled oscillator 80 which generates an A.C. voltage having a constant frequency. The output of the oscillator 80 is coupled to an amplifier 81 which also receives modulation inputs from a resonance circuit 82, the resonance circuit being controlled by the capacitance between sensing discs or electrodes 56, 17'. The capacitance between sensing discs 56, 17', which is result of the relative displacement therebetween, changes the resonance frequency of the resonance circuit 82 as a function of said displacement or variation of capacitance. The capacitance is also dependent on the temperature of the gas between the sensing discs 56, 17', and in order to compensate for variations of said temperature the temperature sensing device 73 is connected via conductor 74 and pin plug device 76 to a further input terminal of said resonance circuit 82. The amplifier 81 generates a modulated A.C. voltage having a constant frequency and an amplitude which is modulated as a function of the varying resonance frequency of the resonance circuit 82. The modulated A.C. voltage is rectified in a rectifier circuit 83 and the rectified voltage is coupled to a low pass filter 84 and then to a discriminator 85. The output of the discriminator 85 is the control voltage for controlling the associated control cylinder 23, 29, 43 via the respective valves 30, 40 and 49.

The control signals actuate the solenoid-type valves such that the corresponding control or power cylinders are connected to the pressure fluid supply or to the pressure fluid outlet (not pressurized) in order to maintain said predetermined clearance between the sealing means 9, 13 and regenerator body during all types of thermal deformation of the regenerator body (called rotor "turn-down").

The solenoid-type valves may be termed generally as "servo-operated" valves. They may be replaced by motor operated valves which are generally known as servo-type valves.

The cylindrical housing 50 preferably is made of metal and the insulating discs 52, 54 of alumina (alumina oxide). In order to minimize the self-capacity of the sensing means the inner diameter of the housing 50 preferably is 80 to 120 mm and the diameter of the conductor 58 is preferably 3 to 5 mm.

Although the invention has been described with reference to heat exchangers having a rotatable regenerator body 1 and stationary ducts, it is evident that it is applicable also to such regenerative heat exchangers having a stationary regenerator body and rotatable ducts.

I claim:

1. In adjusting means for a rotary regenerative heat exchanger, the head exchanger comprising a regenerator body and ducts, said regenerator body and ducts being rotatable relative to each other, said regenerator body having sector plates, sector plate sealing members and at least one circumferential metal flange supported by said regenerator body:

said adjusting means comprising adjusting linkages coupled to said sealing members for adjusting said sealing members, linkage actuating means coupled to said adjusting linkages of said sealing members and which, in response to a thermal deformation of the regenerator body to dish-like shape of the end surfaces of the regenerator body and the corresponding variation of the sealing spaces, actuates said adjusting linkages of said sealing members so as to maintain a predetermined sealing space, and at least one sensing means coupled to each sealing member, adjacent said circumferential metal flange supported by the regenerator body;

the improvement wherein said sensing means comprises an electrically conducting sensing element (56) which is insulated from the respective sealing member and which is positioned close to but spaced from said circumferential metal flange, a control circuit, (19; 39; 33) electrically coupled to said sensing element (56) and to said circumferential metal flange (17', 31', 37') for generating control signals indicating variations of electrical capacity which result in response to variations of the distance between said circumferential metal flange and said sensing element (56), said control signals being supplied to said linkage actuating means for controlling the ajusting of said sealing members (9; 11).

2. The adjusting means of claim 1, wherein each of said sensing means (17; 31; 37) comprises a cylindrical housing (50) having two opposing ends, two insulating elements (52; 54) respectively closing said two opposing ends of said housing, one of said insulating elements (52) facing said regenerator body (1) and supporting said sensing element (56), a first pin plug device (68) at the end of said sensing means facing away from said regenerator body, and an electrical conductor (58) connected to said sensing element (56) and extending through said two insulating elements to said first pin plug device (68).

3. The adjusting means of claims 1 or 2 wherein said sensing element (56) is a sensing disc.

4. The adjusting means of claim 2 wherein each of said sensing means further comprises a further pin plug device (76) located adjacent said first pin plug device (68), an electrical temperature sensing device (73) attached to said cylindrical housing (50) coupled to said further pin plug device (76), said control circuit being coupled to said further pin plug device (76).

5. Adjusting means as claimed in claim 2 wherein said conductor (58) connected to the sensing element (56) extends with a clearance through the other of said insulating elements (54) which closes the end of said cylindrical housing facing away from said regenerator body, a compression spring (64) coupled to said conductor (58) for longitudinally stretching said conductor between said two insulating elements (52, 54), and a further conductor (66) forming an expansion curve coupling said conductor (58) to said first pin plug device (68).

6. The adjusting means of any one of claims 1, 2, 4 or 5 wherein said linkage actuating means includes servo means coupled to said high frequency amplifier for controlling the adjusting of said sealing members.

7. The adjusting means of claim 6 wherein said servo means comprises a solenoid type valve in a pressure fluid supply to a linkage actuating means.

* * * * *